10/22/85 XR 4,548,576

United States Patent [19]

Chesters

[11] Patent Number: 4,548,576

[45] Date of Patent: Oct. 22, 1985

[54] FLAME STABILIZER

[75] Inventor: David A. Chesters, Walton-on-Thames, England

[73] Assignee: British Petroleum Company, London, England

[21] Appl. No.: 593,919

[22] Filed: Mar. 27, 1984

Related U.S. Application Data

[63] Continuation of Ser. No. 60,607, Jul. 25, 1979, abandoned.

[30] Foreign Application Priority Data

Aug. 8, 1978 [GB] United Kingdom ..... 32578/78

[51] Int. Cl.[4] ..... F23D 13/20

[52] U.S. Cl. ..... 431/202; 431/349; 431/350

[58] Field of Search ..... 431/350, 202, 171, 172, 431/345, 346, 349, 354; 239/504, 514, 602

[56] References Cited

U.S. PATENT DOCUMENTS

| | | | |
|---|---|---|---|
| 1,014,932 | 1/1912 | Antonuccio | 431/350 |
| 1,971,554 | 8/1934 | Forster | 431/349 |
| 1,998,257 | 4/1935 | Smith | 431/350 X |
| 2,525,432 | 10/1950 | Stadler | 431/349 |
| 2,537,542 | 1/1951 | Norman, Jr. | 431/349 X |
| 2,676,650 | 4/1954 | Brierly | 431/349 X |
| 2,905,235 | 9/1959 | Dolby | 431/350 X |
| 3,044,537 | 7/1962 | Keating et al. | 431/349 X |
| 3,915,622 | 10/1975 | Desty et al. | 431/202 X |
| 3,995,986 | 12/1976 | Straitz, III | 431/114 |
| 4,099,908 | 7/1978 | Beckmann et al. | 431/202 X |
| 4,125,361 | 11/1978 | Bourn | 431/354 |

FOREIGN PATENT DOCUMENTS

| | | | |
|---|---|---|---|
| 98856 | 1/1921 | Fed. Rep. of Germany | 239/514 |
| 2609258 | 9/1976 | Fed. Rep. of Germany . | |
| 1290043 | 2/1962 | France . | |
| 2331751 | 6/1977 | France . | |
| 795664 | 5/1958 | United Kingdom . | |
| 1249967 | 10/1971 | United Kingdom . | |
| 2007830 | 5/1979 | United Kingdom . | |

*Primary Examiner*—Randall L. Green

*Attorney, Agent, or Firm*—Morgan, Finnegan, Pine, Foley & Lee

[57] ABSTRACT

Flame stabilizer for the outlet of a pipe flare takes the form of a cylinder co-axial with, and inserted into the mouth of the flare, the cylinder being surmounted with a cone diverging in the direction of gas flow. The angle of the cone is from 20° to 40° from the horizontal and the length of the cylinder within the mouth of the flare is from 10 to 40 times the mean radial distance between the inner circumference of the pipe and the outer circumference of the cylinder.

9 Claims, 1 Drawing Figure

FLAME STABILIZER

This is a continuation of application Ser. No. 060,607 filed July 25, 1979, now abandoned.

BACKGROUND OF THE INVENTION

The present invention relates to flares and more particularly relates to flares having flame stabilisers.

The operation of chemical plants, refineries, off-shore oil production and other operations often require the safe and effective disposal of combustible gases. Several forms of flare have been used; for these operations including pipe flares which are relatively simple flares formed from a pipe with an open upper end at which the fuel gas is ignited. However, the flares are often found to be sensitive to wind speed and variations in gas flow which can cause lift off or extinction of the flame.

SUMMARY OF THE INVENTION

The present invention is directed towards flares which are more stable, have a more extended operating life and are more easily ignited for given wind velocities and gas flow rates by the incorporation of a flame stabilising device. Furthermore, the present invention operates under a lower back pressure than conventional baffle type flame stabilisers which cause recirculation and turbulence. The present invention offers a reduced resistance to gas flow and the lower back pressure facilitates the use of pipe flares for disposal of refinery and production flare gas.

Thus, according to the present invention there is provided a flare comprising a substantially vertically disposed pipe adapted to be supplied with combustible gas, said pipe having a flame stabiliser comprising a cylinder co-axial with and lying wholly or mainly within the pipe of the length of the cylinder within the pipe being from 10 to 40 times the mean radial distance between the inner circumference of the pipe and the outer circumference of the cylinder, the cylinder having a divergent portion at the outlet of the pipe, the divergent portion diverging in the direction of gas flow through the pipe at an angle from 20° to 40° from the horizontal.

Preferably the divergent portion is in the form of a truncated cone.

The flame stabiliser may be attached to the pipe by means of welding, use of flanges or other suitable means for attachment.

The flame stabiliser separates off a small portion of fuel gas in the flare pipe. This gas is decelerated by friction in the annulus between the pipe and stbiliser and then allowed to expand through the coned exit. This action provides a small stable flame which tends to stabilise the main gas flame supplied by gas flow through the pipe.

The flame stabiliser is made sufficiently thin to avoid significant problems of turbulence consistent with being robust enough to withstand flare temperature conditions. The stabiliser is fabricated from a metal or heat resistant material and is suitably made of steel.

Preferably, particularly during use on a platform, radiation and/or wind shields are associated with the flare, a suitable wind deflector being described in our UK Pat. No. 795664. Preferably pilot lights are used on a flare comprising the flame stabiliser.

The invention will now be described by way of example only and with reference to the accompanying, FIG. 1.

DESCRIPTION OF THE PREFERRED EMBODIMENT

Figure 1:
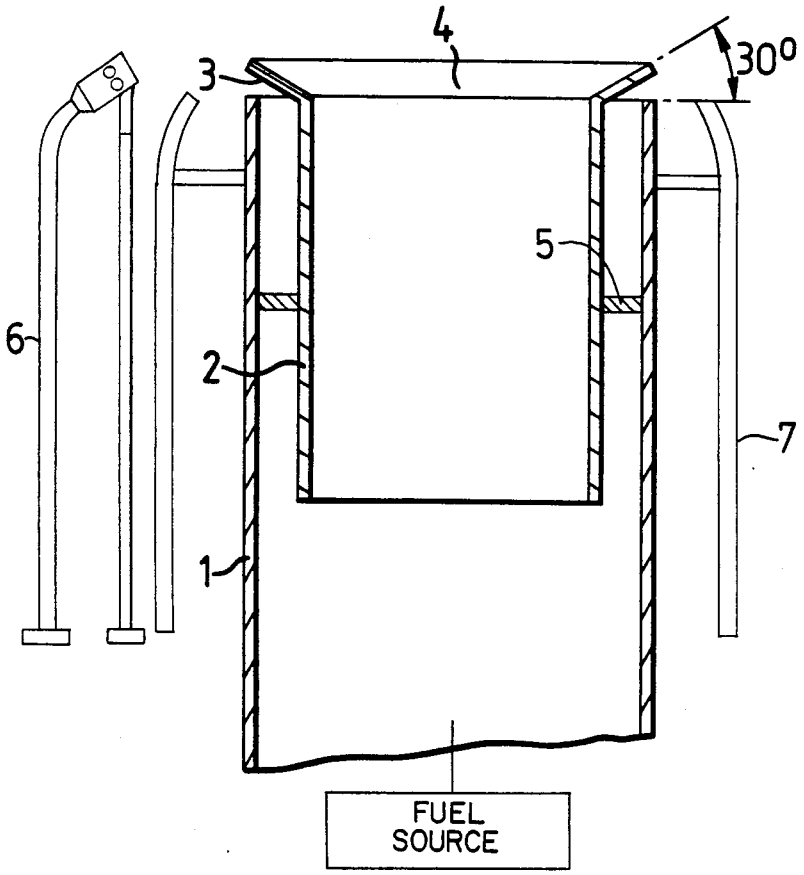
FIG. 1 illustrates a vertical section through a pipe flare having a flame stabiliser according to the invention fitted to its outlet.

Referring to FIG. 1, the upper part of the vertical pipe flare is indicated generally by the numeral 1. This is a large ten inch internal diameter metal pipe of circular cross-section and is supplied with fuel gas. A flame stabiliser comprising a six inch long cylinder 2 of external diameter of nine and a half inches lies within the pipe 1 being supported therein by means of a plurality of interconnecting struts 5, and having a divergent surmounted cone 3 lying outside the pipe 1 at its outlet 4. The angle of divergence of the cone 3 is 30° to the horizontal and the cone length is about two inches. Associated with the flare are a pilot and ignition system 6 and a radiation and/or wind shield 7.

In operation of the flare, a gaseous fuel is provided from a source of supply (not shown) through the vertical pipe 1 of the flare. A small portion of the fuel passing along the pipe 1 is separated from the main flow and passes along the annulus between the pipe 1 and the cylinder 2. This gas is retarded by pipe friction and then passes out of the coned exit 3. Thus a small stable flame is allowed to develop above the coned exit 3 which is used to stabilise the faster flowing main gas flow through the central duct bounded by cylinder 2.

The table shows data obtained with the flare in comparison with a more conventional baffle type of flame stabiliser in which the baffle obstructs the gas flow causing it to decelerate and create turbulence. The table shows that the use of the baffle stabiliser tends to lead to high and undesirable flare temperature and reduced pressure head losses in the pipe.

TABLE 1

Results for baffle type and conical type stabiliser on 10" pipe flare

| | Flare Tip Temperature °C. | | Pressure Head Loss Inches water gauge | |
|---|---|---|---|---|
| Gas Flow MMSCFD | Conical Type Stabiliser | Baffle Type Stabiliser | Conical Type Stabiliser | Baffle Type Stabiliser |
| 2 | 165 | 200 | 0.1 | 0.1 |
| 6 | 125 | 420 | 0.5 | 2.5 |
| 12 | 130 | 600 | 5.5 | 15.5 |

Wind Speed 7–15 knots.

Further, tests for a series of flow rates, showed that flame stability of the flare was dependent upon the cone angle of the flame stabiliser. Thus, for cone angles of greater than 40° (from the horizontal), the flame tended to lift off and any wind tended to extinguish the flame. At cone angles from 20° to 40°, a holding flame was set up at the pipe outlet which tended to stabilise the main flame. At cone angles of less than 40°, the fuel gas tended to recirculate around the flare pipe causing the flare tip to become undesirably hot.

A similar type of dependency of flame stability was also obtained by varying the length of the flame stabiliser cylinder with the mouth of the flare pipe. For a cylinder length within the pipe of less than 10 times the mean radial distance between the inner circumference of the pipe and the outer circumference of the cylinder, flame lift off tended to occur and flame stability was achieved only when the cylinder length within the pipe was ten or more times the radial distance.

The length of the conical section of the flame stabiliser is critical to the stability of the flame and also affects the temperature and hence the operational life of the stabiliser.

At cone lengths less than the mean radial distance between the inner circumference of the pipe and the outer circumference of the cylinder of the stabiliser, the flame tended to be unstable and at cone lengths greater than 20 times the mean radial distance between the inner circumference of the pipe and the outer circumference of the cylinder of the stabiliser the temperature of the flame stabiliser rose to unacceptable levels, i.e. caused structural degradation.

I claim:

1. An apparatus for the burning of combustible neat gas from industrial chemical and refining operations comprising a flare for disposing of combustible neat gas in industrial, refining, chemical, and oil production operations, said flare having a substantially vertically disposed pipe connected to a source of combustible neat gas, said pipe having a flame stabilizer comprising a cylinder co-axial with and lying substantially within the pipe, the length of the cylinder within the pipe being at least ten times the mean radial distance between the inner circumference of the pipe and the outer circumference of the cylinder, the cylinder being surmounted with a cone at the outlet of the pipe, the cone diverging in the direction of gas flow through the pipe at an angle of from 20° to 40° to the horizontal, the length of the cone being from one to twenty times the mean radial distance between the inner circumference of the pipe and the outer circumference of the cylinder.

2. A flare according to claim 1 in which the divergent portion is in the form of a truncated cone.

3. A flare according to claim 1 or claim 2 in which the flame stabiliser is fabricated from steel.

4. A flare according to claim 1 or claim 2 further comprising a radiation and/or wind shield adjacent the outlet of the pipe.

5. A flare according to claim 1 or claim 2 further comprising a ignition and pilot light system adjacent the outlet of the pipe.

6. In a flare for disposing of combustible neat gas from industrial, refining, chemical, and oil production operations comprising a substantially vertically disposed pipe connected to a source of combustible neat gas under a wide range of gas pressures and ambient wind speeds, the improvement comprising a flame stabilizer including a cylinder co-axial with and lying substantially within the pipe, the length of the cylinder within the pipe being at least ten times the mean radial distance between the inner circumference of the pipe and the outer circumference of the cylinder, the cylinder being surmounted with a cone at the outlet of the pipe, the cone diverging in the direction of gas flow through the pipe at an angle of from 20° to 40° to the horizontal, the length of the cone being from one to twenty times the mean radial distance between the inner circumference of the pipe and the outer circumference of the cylinder.

7. A flare according to claim 6 in which the divergent portion is in the form of a truncated cone.

8. A flare according to claim 6 or claim 7 further comprising a ignition and pilot light system adjacent the outlet of the pipe.

9. A flare according to claim 6 or claim 7 further comprising a radiation and/or wind shield adjacent the outlet of the pipe.

* * * * *